United States Patent [19]

Watanabe

[11] Patent Number: 4,785,479

[45] Date of Patent: Nov. 22, 1988

[54] GLOVE AND THE METHOD OF MAKING THE SAME

[75] Inventor: Shigeru Watanabe, Karatsu, Japan

[73] Assignee: Towa Glove Co., Ltd., Japan

[21] Appl. No.: 124,258

[22] Filed: Nov. 23, 1987

[51] Int. Cl.[4] ..... A41D 19/00

[52] U.S. Cl. ..... 2/163; 2/167; 2/169

[58] Field of Search ..... 2/163, 159, 161 R, 167, 2/168, 169

[56] References Cited

U.S. PATENT DOCUMENTS

| | | | |
|---|---|---|---|
| 3,026,531 | 3/1962 | Holaday | 2/167 |
| 3,961,377 | 6/1976 | Lars-Jos | 2/169 |
| 4,445,232 | 5/1984 | Nelson | 2/167 X |

*Primary Examiner*—Louis K. Rimrodt

*Assistant Examiner*—J. L. Olds

*Attorney, Agent, or Firm*—Jones, Tullar & Cooper

[57] ABSTRACT

A glove comprising a glove base, a reinforcing sheet disposed thereon, and a reinforcing film of rubber or synthetic resin as coated on or impregnated into at least said reinforcing sheet, said glove base comprises a plurality of sheet pieces of required shapes sewn together with seams on the inner side thereof, said sheet pieces being soft, flexible closed-cell foamed rubber or plastic sheet pieces, said reinforcing sheet being a knitted or woven fabric laminated at least to the entirety or a part of the exterior surface of the sheet piece covering the palm of the glove, and the seam cavities of sheet pieces formed on the inner side of said glove base having been filled with rubber or synthetic resin.

The glove excells in cold protection, water proofness, abrasion resistance, and ease of articulation.

6 Claims, 5 Drawing Sheets

GLOVE AND THE METHOD OF MAKING THE SAME

BACKGROUND OF THE INVENTION

1. Field of the Invention

The present invention relates to gloves and a method for making the same. More particularly, the invention relates to gloves for use in various operations calling for water proofness and protection against cold and a method for manufacture of such gloves.

Gloves made of flexible foamed chloroprene rubber sheet have been used by divers and surf riders for cold protection. A glove of this type fits intimately with the hand and meets the cold protection requirement but has the following drawbacks.

(a) This type of glove is fabricated by bonding the end faces of component parts together with an adhesive while adjustment is made with fingers so that the final glove will be three-dimensional. Therefore, the process cannot easily be mechanized for mass production, with the result that the manufacturing cost of the glove is high.

(b) In end-to-end bonding or butt-adhesion, the bonding effect is sometimes incomplete. In such cases, the glove is not completely water-proof and is poor in strength.

(c) Unless the two component parts to be bonded are equal in elongation, they tend to become separated. Moreover, if they are of dissimilar materials, no adhesion may be obtained at all, depending on cases.

(d) In end-to-end bonding, if the foamed chloroprene rubber sheet is thin (particularly when it is less than 2 mm), the bonding area is so small that no sufficient bond strength can be obtained.

(e) The glove for use in water-associated operations in cold climate must be cold-proof, water-proof and abrasion-resistant.

OBJECT AND SUMMARY OF THE INVENTION

Accordingly, the object of the present invention is to provide a glove which excells in cold protection, water proofness, abrasion resistance, and ease of articulation.

In accordance with the present invention, there is provided a glove comprising a glove base formed by cutting a soft, flexible closed-cell rubber sheet (hereinafter referred to sometimes as foamed hneet) to give a plurality of sheet pieces of required shapes, laminating at least either the entirety or a part of the palm sheet piece with a woven or knitted fabric, sewing together said plurality of sheet pieces, and turning the resulting sewn assembly inside out, said woven or knitted fabric on the surface of said glove base carrying a reinforcing film of rubber or synthetic resin as formed by impregnation, the seam cavities formed upon turning the sewn assembly inside out having been filled with rubber or synthetic resin, and said glove base having been molded by heating on a hand mold.

In another aspect, the present invention provides a method of manufacturing a glove which comprises (a) a step of cutting a soft, flexible closed-cell framed sheet to give a plurality of sheet pieces of required shapes, sewing together said plurality of sheet pieces, and turning the sewn assembly inside out to give a glove base, (b) a step of setting said glove base on a mold simulating the natural shape of a hand, (c) a step of depositing a rubber or synthetic resin latex or paste on the surface of the glove base on said mold, and (d) a step of curing said latex or paste in situ on the mold by drying, vulcanization, fusion, or the like so as to give a reinforcing film on the outer surface of the glove base.

BRIEF DESCRIPTION OF THE DRAWINGS

FIG. 5 (b) is a transverse section view showing the glove base of FIG. 5 (a) after heating;

DETAILED DESCRIPTION OF THE INVENTION

Figure 1:
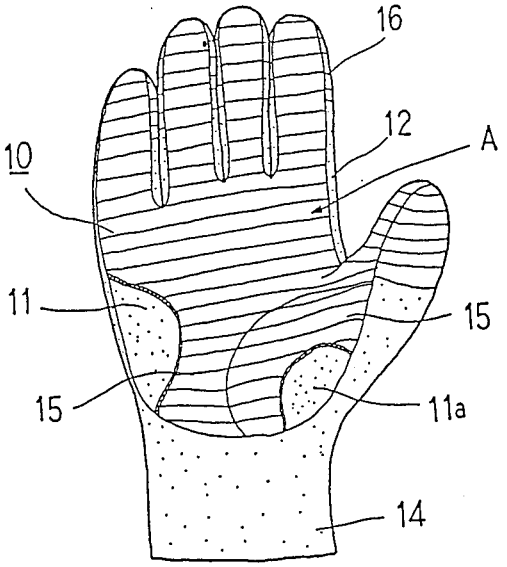
FIG. 1 is an elementary front view showing, in partial section, the glove base obtainable by sewing together its component sheet members and turning the assembly inside out.

The glove according to this invention has cold-proof and water-proof functions and does not interfere with the mvement of the hand and the articular movement of the fingers. For these purposes, a soft, flexible plastic foam sheet of the closed cell type is used. This sheet is cut into pieces of required shapes which are sewn together and turned inside out to form a glove base. The plastic foam mentioned above may for example be chloroprene rubber, chlorosulfonated polyethylene, ethylene-propylene rubber or polyurethane rubber.

The sheet member forming the dorsal part of the glove is usually subject to a tensile force when the hand is moved or the fingers are bent. Therefore, it is preferable to cut the sheet in such a manner that when a plurality of sheet pieces are sewn together and the assembly is turned inside out, it will naturally conform to the shape of the hand and, then, sew the pieces together to form a geometric glove base which will not substantially interfere with the movement of the hand and the articulation of the fingers. Other effects of forming such a geometric glove base will be described hereinafter.

If the primary objective of the glove base is cold resistance, it will have to be thick all over, with compromises in the freedom of hand movement and in the tactile sensibility of the fingers. Conversely, if priority is given to the freedom of hand movement, the glove is to be thin all over so that the cold resistance feature must be sacrificed.

Referring to the need for warmth retention of hands, the dorsal side of the hand has many superficial blood vessels so that it must be kept warm particularly when prolonged work is expected. In contrast, the palm and fingers of the hand do not need as much warmth retention as does the dorsal side and the glove is preferably thin in these parts in order to assure a freedom of movement.

Therefore, it is preferable that the palm side of the glove base be formed of a sheet thinner than that for the dorsal side and also that the finger parts of the dorsal side be formed of a sheet thinner than that for the remainder of the dorsal side (palm sheet < finger sheet < dorsal sheet) so as to assure both warmth retention and freedom of movement. Of course, the palm side and dorsal side of the glove may be made of sheets of the same thickness. In this case, however, the use of a more flexible sheet for the finger parts than for the palm side provides a greater freedom of finger movement.

Of the sheet pieces constituting the glove base, at least the palm piece is laminated with a knitted or woven fabric (hereinafter referred to sometimes as fabric). This fabric not only serves as a reinforcing sheet but, as will be described hereinafter, is used when slip-proof projections or corrugations are formed on the palm piece. As an example of such fabric, there may be mentioned a knitted or woven fabric of nylon filament.

From the standpoint of abrasion resistance, the dorsal side of the finger part is also laminated with a fabric. When the glove is intended for general work, it is sufficient that the fabric covers the finger at least from the fingertip to a position intermediate between the first and the second joint. However, when the glove is for special types of work, the fabric preferably covers the finger down to the third joint. It is also possible to apply fabric claddings to all the sheet pieces forming a glove base.

The fabric on the surface of said glove base is coated or impregnated with a latex, paste or solution of rubber or synthetic resin to form a reinforcing film.

The rubber or synthetic resin which can be used in the preparation of such an impregnating or coating composition may be any of the materials mentioned for the foam sheet, such as chloroprene rubber, chlorosulfonated polyethylene, ethylene propylene rubber, urethane rubber, etc., although it may be any other material only if it has a good adhesive affinity for said foam sheet.

The diluent for use in such an impregnating or coating composition may for example be water for the latex, or any of the known diluents and solvents for the plastisol and solution. As rheology modifiers, Latekoll (alginic acid alcohol, Bayer) for the latex and Aerosil (silicon dioxide, Japan Aerosil) for the plastisol and solution may be employed, for instance.

In the impregnating or coating composition, there may also be incorporated such other additives as dyes, fillers, stabilizers, crosslinking agents and so forth in suitable proportions.

Generally, the viscosity of the impregnating or coating composition is preferably in the range of 200 to 2000 cps. If the viscosity is less than 200 cps, there cannot be obtained a sufficiently thick reinforcing film and, moreover, the surface strength will not be as high as desired. On the other hand, if the viscosity of the composition exceeds 2000 cps, bubbles may be trapped in the course of deposition so as to detract from the effect of the slip-proof devices to be formed on the palm side of the glove.

When the reinforcing film is to be produced by the dipping method, the glove base may be simply dipped into a bath of the above composition. When the coating method is employed, the glove base may be coated with the composition by means of a known coater device such as the brush, spray gun, and so on.

The glove base treated with such a synthetic resin composition is dried in a suitable dryer such as a circulating air drier under conditions suited to the composition. For example, when chloroprene rubber latex is used, the drying operation is conducted at about 70° C. for about 120 minutes, followed by vulcanization at about 140° C. for 20 minutes. When a vinyl chloride paste is used, drying-gelation is carried at about 100° C. for 20 minutes, followed by fusion at about 180° C. for 10 minutes to thereby give a reinforcing film.

As already mentioned, the glove base is made by sewing at least two sheet pieces together and turning the assembly inside out. Therefore, the surface of the glove base is formed with substantially V-shaped seam cavities. For prevention of water leakage, for instance, these seam cavities are filled with rubber or synthetic resin. This filling is generally achieved by the very dipping or coating operation for the formation of a reinforcing film. As the rubber or synthetic resin finds its way into the seam cavity, not only the prevention of water leakage but also an adhesive reinforcement of the sheet pieces can be accomplished. This rubber or synthetic resin may be of the same type as the glove base material but may be a different one such as a material having improved oil or chemical resistance.

When the surface of the glove base has a fabric, the rubber or synthetic resin is deposited as entangled with the filaments of the fabric. Therefore, as said rubber or synthetic resin, a material which is not well compatible with the glove base material can be employed.

When the dipping method is applied to the deposition of rubber or synthetic resin, a reinforcing film of rubber or synthetic resin can be produced on the dorsal side as well as on the palm side.

In case where said fabric is available on the palm side of the glove base and not available on the dorsal side, the rubber or synthetic resin is thickly deposited on the palm side of the glove base while a thinner coat is obtained on the dorsal side. Therefore, compared with the case in which the coat on the dorsal side is as thick as that on the palm side, there is only a reduced resistance to the movement of the hand or the articulation of fingers on the dorsal side.

As the fabric to be applied to the palm side of the glove base, one having projections or coagulations can be employed. As an example of such fabric, there may be mentioned a towel-weave fabric having piles at optional intervals on one side. When the glove is made using such a towel-weave fabric, slip-proof projections of rubber or synthetic resin are formed using said piles as cores on the palm side of the glove base. The sharpness of such slip-proof projections varies with the towel-weave material. Incidentally, when the surface reinforcing film wears out as the glove is used repeatedly, the tip of the pile is exposed so that a greater slip-proof effect is obtained when water-wet objects are handled. Therefore, this is advantageous for water-handling operations.

Since the glove base is turned inside out after sewing, the seam projection of the sewing margin is ill-fitting and gives discomfort when the glove is put on the hand. Therefore, if the glove base is put under slight tension on a mold simulating a hand with fingers naturally bent toward the palm side, the inner surface of the glove is compressed against the mold owing to the shrinking force of the glove base. If the heat treatment is carried out in this condition, inwardly projecting lapped sheet edges forming the seam are softened and deformed by the heat of the mold and the foam is crushed by the tension of the glove base so that the projection is not so pronounced as it was before setting. Thus, the foreign body sensation on wearing the glove is eliminated.

Even if the glove base is formed by two-dimensional cutting and two-dimensional sewing, a glove simulating the natural shape of a hand can be obtained only if it is heat-molded on a mold simulating the natural shape of the hand. However, the dorsal side of the glove base set over the mold has been thinned due to a great tensile force, so that if it is allowed to set, the heat-insulation property is remarkably decreased so that the meaning of using a foam sheet is lost. Therefore, the glove base is preferably formed by geometric cutting and geometric sewing in conformity with the natural shape of the hand and molded and set substantially without a change in thickness on the dorsal part.

The glove can be made easier to put on and off if a flexible slick cloth such as a nylon knit is attached to the inner side of the sheet pieces of the glove base.

This invention affords the following beneficial results.

(a) As a closed-cell foam sheet is used for the glove base, the glove is highly heat-insulating and, even if water finds its way into the glove, the glove base itself does not absorb water. Therefore, the glove is suitable for water-handling operations in cold weather.

(b) The glove base is made of soft, flexible foam sheet and is heat-molded on a mold simulating the natural shape of a hand so that the glove base is thermally deformed to fit the hand, with the result that the glove follows the movement of the hand well and does not cause fatigue even after a long time of work.

(c) When a glove is formed by butt-jointing, the two sheets to be bonded must be equal in thickness, for otherwise a step is formed to catch on the hand and other objects to cause inconveniences in work. However, the glove according to this invention is formed by sewing and even if the two sheets to be sewn together are not equal in thickness, there is formed no step. Therefore, a glove with such a variation in thickness as to assure both cold resistance and freedom of movement ca be provided.

Moreover, materials differing in flexibility or materials differing in properties so that they cannot be joined with an adhesive can be employed in accordance with this invention.

(d) The liquid composition used to form a reinforcing film seeps into the fabric and is entangled with its filments, with the result that the reinforcing film is hardly separable and the abrasion resistance of the fabric is also remarkably increased.

(e) The seam cavities formed upon turning the glove base inside out after the sewing step is filled with rubber or synthetic resin so that the seam is reinforced and the leakage of water at the seam is prevented.

(f) The liquid composition used to form a reinforcing film penetrates into the seam-forming thread and fills up the thread and needle holes. Therefore, there occurs no breakage of the seam and even if the thread is cut, there occurs neither a local raveling nor a "run". In delicate fingertip operations such as putting a bait on a fishing hook, one generally uses the glove after cutting off its fingertip parts. The glove according to this invention can be used as it is in such applications.

(g) As the glove base is formed by sewing and, then, molded over a glove mold, gloves of uniform quality can be fabricated without requiring a high degree of skill. Therefore, the process can be mechanized so that the cost reduction can be realized without variation in the quality of products.

(h) In the heat molding stage, the glove base is set under tension over the mold. Therefore, as the seam projections of sheet pieces are heated as pressed against the mold, they are flattened. Therefore, the seam (margin for sewing) does not give a foreign body sensation on wearing the glove.

EXAMPLE 1

Referring to FIGS. 1 to 4 which show an embodiment of the present invention, a glove base 10 is formed by sewing pieces of closed-cell chloroprene rubber foam sheet and turning the assembly inside out. The sheet pieces forming the glove base 10 consist of a palm sheet piece 11, a thenar sheet piece 11*a*, a dorsal sheet piece 12, and dorsal finger sheet pieces 13, all having been cut so that they form a three-dimensional shape on sewing together.

Figure 2:
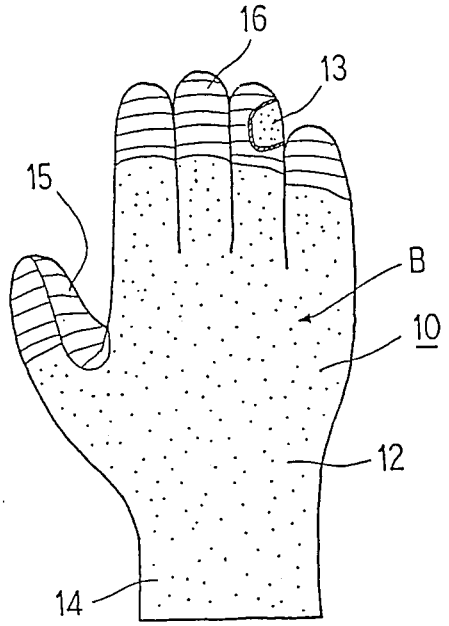
FIG. 2 is an elementary rear view showing, in partial section, the glove base depicted in FIG. 1.

The dorsal finger sheet pieces 13 have been cut so that when the glove is put on the hand, they cover the fingers from the tip to a position between the first and the second joint. The dorsal sheet piece 12, as shown in FIG. 2, has an integral wrist portion 14 adapted to cover the wrist and a portion of the forearm.

The palm sheet piece 11 and thenar sheet piece 11*a* have a thickness (about 2.0–2.5 mm) which does not adversely affect the tactile sensation of the fingers, and the dorsal sheet piece 12 and dorsal finger sheet pieces 13 have a thickness (about 3.0 mm) which serves the purposes of cold insulation.

Each of the above sheet pieces is provided with a slip sheet 17 consisting in a slippery nylon knit (70 deniers) on the side which becomes the reverse side upon turning the sewn assembly inside out.

The palm sheet piece 11 and the thenar sheet piece 11*a* are each provided with a reinforcing sheet 15 consisting in a corrugated nylon knitted fabric (one nylon filament of 70 deniers for the recess and three nylon filaments of 70 deniers for the projection) as attached with an adhesive to the side which becomes the face side upon turning the sewn assembly inside out.

The dorsal finger sheet piece 13 is provided with a reinforcing sheet 16 consisting in a nylon knitted fabric (70 deniers) on the side which becomes the face side upon turning the sewn assembly inside out.

These palm sheet piece 11, thenar sheet piece 11*a*, dorsal sheet piece 12 and dorsal finger sheet pieces 13, each in two, are sewn together along the edges with a thread 21 and the assembly is turned inside out to form the glove base 10.

As a result, a seam projection 18 of two overlapped parts is formed along the joint of the respective sheets and a seam cavity 19 is formed behind the seam projection 18.

Figure 3:
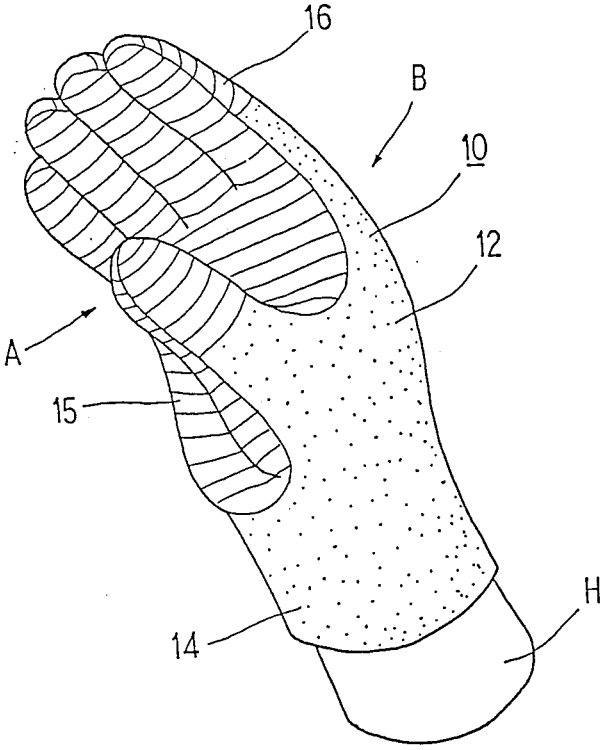
FIG. 3 is an elementary perspective view showing the glove base as mounted on a glove mold in advance to the formation of a reinforcing film.
Figure 4:
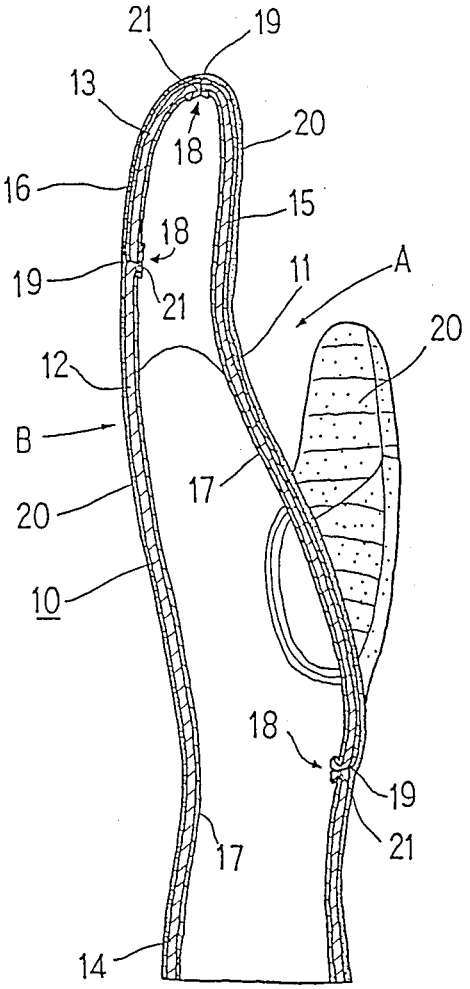
FIG. 4 is a longitudinal section view showing the main part of the glove carrying a reinforcing film according to a first embodiment.
Figure 5:
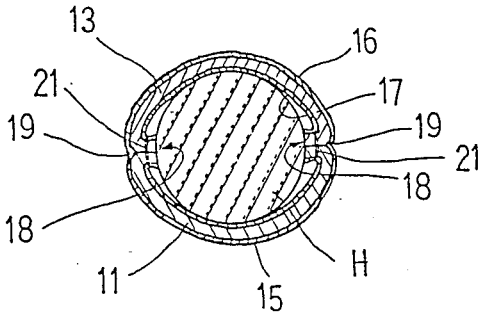
FIG. 5 (a) is a transverse section view showing the relation between the glove mold and the seam projections after setting of the glove base on the glove mold prior to heating.
Figure 5:
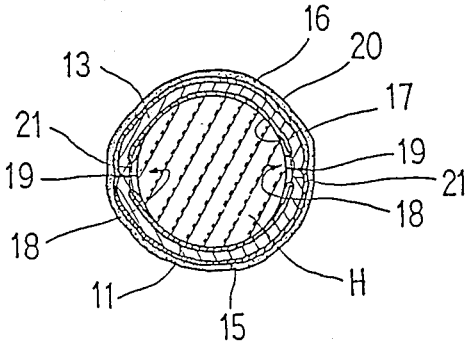

By taking advantage of its flexibility, this glove base 10 is set over a glove mold H simulating the natural shape of a hand (FIG. 3). In this operation, the seam projection 18 is in contact with the glove mold H at its ends as shown in FIG. 5 (a).

The glove base 10 thus set over the mold H is dipped in a latex of the following composition (viscosity 450 CPS). In this operation, the reinforcing sheets 15, 16 are impregnated with the latex.

| Ingredients | Parts by weight |
|---|---|
| Neoprene latex #650 | 100 (nonvolatile matter) |
| Aqualex SMO (stabilizer) | 3 |
| Aqualex WAQ (stabilizer) | 1 |
| Sulfur (vulcanizer) | 1 |
| Zinc flower No.1 (vulcanizer) | 5 |
| Sanceler TT (accelerator) | 2 |
| NOC. ROC. NBC (aging inhibitor) | 2 |
| Crown clay (filler) | 10 |
| Carbon black (pigment) | 1.5 |
| Latekoll AS (thickener) | 0.25–0.5 |
| Process oil (softening agent) | 5 |
| Dispersing agent or stabilizer | q.s. |

The glove base is dried at 80° C. for 120 minutes and, then, vulcanized at 140° C. for 20 minutes.

By the above step, the glove base 10 is molded and set in a shape corresponding to the glove mold H and, at the same time, a water-proof reinforcing film 20 is formed on the outer surface of the glove base 10. Furthermore, the seam projection 18 consisting of two overlapped parts of sheets and extending inwardly is deformed from the shape illustrated in FIG. 5 (a) to the shape illustrated in FIG. 5 (b), thus being flattened.

The glove according to this embodiment has a thin reinforcing film 20 only on the dorsal sheet piece 12 of the dorsal side B. Therefore, there is substantially no resistance to the elongation of the dorsal sheet piece due to the articulation of fingers or the like.

EXAMPLE 2

Figure 7:
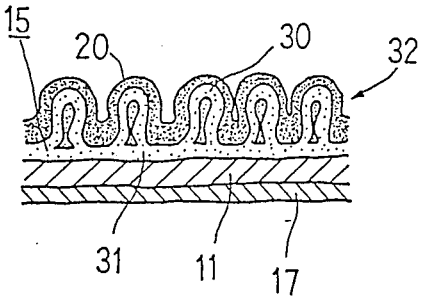
FIG. 7 is a detailed view showing the part C of FIG. 6 on an exaggerated scale.
Figure 6:
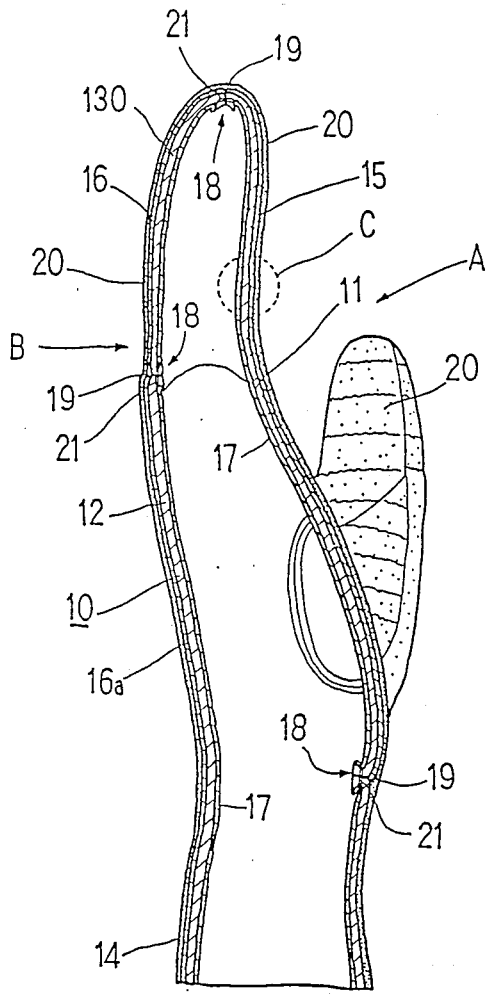
FIG. 6 is a longitudinal section view showing the main part of the glove according to a second embodiment.

Referring to FIGS. 6 and 7 whch illustrate a second embodiment of this invention, the parts corresponding to the like parts in the first embodiment are designated by the like symbols. The glove base 10 is made of closed-cell chloroprene rubber sheet which is soft and flexible and is similar to the glove base of the first embodiment except in the following aspects.

(1) The dorsal finger sheet piece 130 has been cut so that when the glove is put on the hand, it covers the area from the fingertip to a position between the second and the third point.

(2) The dorsal finger sheet piece 130 is made of a sheet having a thickness (about 3.0–3.5 mm) which does not interfere with the movement of the fingers, while the dorsal sheet piece 12 is made of a sheet having a different thickness (about 5.0 mm) which is as great as meets the cold insulation requirement.

(3) Each of the palm sheet piece 11 and thenar sheet piece **11*a* has a towel weave nylon fabric having piles 30 (See FIG. 7; the ground texture 31 made of 70-denier nylon filament and the pile 30 made of 120-denier nylon filament) as a reinforcing sheet 15** bonded with an adhesive to the face side.

(4) The dorsal sheet piece 12 also has a reinforcing sheet **16*a* (thinner than the reinforcing sheet 16**) which is a nylon knit (70-denier).

The above glove base 10 is set over the same mold H as used in Example 1 and is immersed in a plastisol of the following composition. In this process, the reinforcing sheets 15, 16 and **16*a*** are impregnated with the plastisol.

| Ingredients | Parts by weight |
|---|---|
| Vinyl chloride resin HX-13 | 100 |
| DOP (dioctyl phthalate) (plasticizer) | 110 |
| DOA (dioctyl adipate) (plasticizer) | 20 |
| Polyester plasticizer | 10 |
| Calcium-zinc system (stabilizer) | 2 |
| Aerosil (gelling agent) | 2 |
| Pigment | 2 |
| Solvesso (diluent) | 30–50 |

The glove base is then dried at 100° C. for 20 minutes, whereby the diluent is removed. The glove base is further heated at 180° C. for 10 minutes. As the reinforcing sheet 15 is impregnated with the plastisol, non-slip projections 32 of vinyl chloride resin are formed on the palm side of the glove with the piles serving as cores as shown in FIG. 7 which is an enlarged view of part C of FIG. 6. In this process, the glove base 10 is molded and set in the shape corresponding to the glove mold H and the seam projection 18 consisting of two overlapped sheet parts is deformed and flattened just as in the first embodiment.

In this embodiment wherein the reinforcing sheets 15, 16 and 16 i a are impregnated with the plastisol, the reinforcing film 20 may be made of vinyl chloride resin which has a poor adhesive affinity for the chloroprene rubber forming the glove base 10. Furthermore, as the reinforcing film 20 is formed on the reinforcing sheets 16 and **16*a*, the reinforcing sheets 16, 16*a*** have a water-holding property so that the loss of body weight by the latent heat of evaporation can be prevented, with the consequent good warmth retention effect.

Moreover, as the reinforcing sheet **16*a* is thinner than the reinforcing sheet 16, the reinforcing film 20** formed thereon is also thinner so that the freedom of movement of the hand is not adversely affected.

The abrasion resistance of the glove according to the first embodiment was compared with that of a glove consisting of a foamed chloroprene rubber sheet and a nylon knit (70-denier) laminated thereto (without impregnation with a latex).

Abrasion tester:

TABER type abrasion testing machine (Toyo Seiki Seisakusho K.K)

Abrasion wheel used:

Carrigrade hard abrasion wheel, grit H22.

Load: >500 g.

The palm abrasion test was conducted under the above conditions. In the case of the glove consisting of a foamed chloroprene rubber sheet and a nylon knit fabric, the knit fabric was destroyed to expose the underlying chloroprene rubber within 1,000 cycles. In the case of the glove according to the first embodiment, the chloroprene rubber was not exposed even after 10,000 cycles.

What is claimed is:

1. A glove comprising a glove base, a reinforcing sheet disposed thereon, and a reinforcing film of rubber or synthetic resin as coated on or impregnated into at least said reinforcing sheet, said glove base comprises a plurality of sheet pieces of required shapes sewn together with seams on the inner side thereof, said sheet pieces being soft, flexible closed-cell foamed rubber or plastic sheet pieces, said reinforcing sheet being a knitted or woven fabric laminated at least to the entirety or a part of the exterior surface of the sheet piece covering the palm of the glove, and the seam cavities of sheet pieces formed on the inner side of said glove base having been filled with rubber or synthetic resin.

2. A glove according to claim 1 wherein said glove base comprises sheet pieces cut and sewn together to present a shape simulating the natural shape of a hand.

3. A glove according to claim 1 wherein the palm side of said glove base is made of a sheet piece which is thinner than the sheet piece forming the dorsal side of the glove base.

4. A glove according to claim 1 wherein, on the dorsal side of fingers, a knitted or woven fabric has been laminated over the range from the fingertip to an optional position down to the root of the finger.

5. A glove according to claim 1 wherein said knitted or woven fabric on the palm side has slip-proof corrugations or projections and slip-proof elements of rubber or synthetic resin have been formed using said corrugations or projections as cores.

6. A method of manufacturing a glove which comprises a method of manufacturing a glove which comprises (a) a step of cutting a soft, flexible closed-cell foamed sheet to give a plurality of sheet pieces of required shapes, sewing together said plurality of sheet pieces, and turning the sewn assembly inside out to give a glove base, (b) a step of setting said glove base on a mold simulating the natural shape of a hand, (c) a step of depositing a rubber or synthetic resin latex or paste on the surface of the glove base on said mold, and (d) a step of curing said latex or paste in situ on the mold by drying, vulcanization, fusion, or the like so as to give a reinforcing film on the outer surface of the glove base.

* * * * *